US005927118A

United States Patent [19]

Minote et al.

[11] Patent Number: 5,927,118

[45] Date of Patent: Jul. 27, 1999

[54] METHOD FOR MAKING HOT-ROLLED STEEL SHEET AND APPARATUS THEREFOR

[75] Inventors: Toru Minote, Fukuyama; Shozo Azuma, Tokyo; Sadakazu Masuda, Fukuyama; Masaaki Yamamoto, Fukuyama; Hisatomo Eda, Fukuyama; Takumasa Terauchi, Fukuyama; Masaru Miyake, Fukuyama; Yoshimichi Hino, Fukuyama; Hiroshi Sekine, Fukuyama, all of Japan

[73] Assignee: NKK Corporation, Tokyo, Japan

[21] Appl. No.: 08/862,834

[22] Filed: May 23, 1997

[30] Foreign Application Priority Data

| | | | |
|---|---|---|---|
| May 28, 1996 | [JP] | Japan | 8-133906 |
| May 28, 1996 | [JP] | Japan | 8-133907 |
| Jul. 9, 1996 | [JP] | Japan | 8-179236 |

[51] Int. Cl.[6] ..... B21B 37/74

[52] U.S. Cl. ..... 72/11.3; 72/12.2; 72/161; 72/202; 72/250; 72/365.2; 72/342.96

[58] Field of Search ..... 72/8.3, 8.5, 8.8, 72/9.1, 11.1, 11.2, 11.3, 11.7, 12.2, 365.2, 200, 202, 250, 160, 161, 164, 342.5, 342.6, 342.96, 342.94; 219/602, 645, 656, 673; 432/45, 59, 230

[56] References Cited

U.S. PATENT DOCUMENTS

| | | | |
|---|---|---|---|
| 3,471,673 | 10/1969 | Frostick . | |
| 3,705,967 | 12/1972 | Bobart et al. . | |
| 3,877,867 | 4/1975 | Tsuchiya et al. . | |
| 4,745,786 | 5/1988 | Wakako et al. | 72/11.3 |
| 5,133,205 | 7/1992 | Rostik et al. | 72/202 |
| 5,611,232 | 3/1997 | Rohde et al. | 72/202 |
| 5,634,360 | 6/1997 | Tazoe et al. | 72/250 |

FOREIGN PATENT DOCUMENTS

| | | | |
|---|---|---|---|
| 0 243 340 | 10/1987 | European Pat. Off. . | |
| 0 531 755 | 3/1993 | European Pat. Off. . | |
| 2 002 190 | 10/1969 | France . | |
| 2 373 402 | 6/1978 | France . | |
| 63-33112 | 2/1988 | Japan | 72/8.5 |
| 63-93406 | 4/1988 | Japan | 72/8.5 |
| 2-303619 | 12/1990 | Japan | 72/202 |
| 4-172122 | 6/1992 | Japan | 72/202 |
| 4-178209 | 6/1992 | Japan | 72/37 |
| 5-57323 | 3/1993 | Japan | 72/202 |
| 6-15321 | 1/1994 | Japan | 72/11.3 |
| 1 453 489 | 10/1976 | United Kingdom . | |

OTHER PUBLICATIONS

Patent Abstracts of Japan, vol. 009, No. 135 (M–386), Jun. 11, 1985 of JP 60 018217 A (Nippon Kokan KK), Jan. 30, 1985.

Patent Abstracts of Japan, vol. 018, No. 151 (M–1576), Mar. 14, 1994 of JP 05 329519 a (Mitsubishi Heavy Ind. Ltd.), Dec. 14, 1993.

Patent Abstracts of Japan, vol. 018, No. 583 (M–1699), Nov. 8, 1994 of JP 06 218405 A (Sumitomo Metal Ind. Ltd.), Aug. 9, 1994.

Patent Abstracts of Japan, vol. 004, No. 050 (C–007), Apr. 16, 1980 of JP 55 021511 A (Nippon Steel Corp), Feb. 15, 1980.

Patent Abstracts of Japan, vol. 005, No. 147 (M–088), Sep. 17, 1981 of JP 56 077002 A (Mitsubishi Electric Corp.), Jun. 25, 1981.

"Induction Heating for Steel Forming", Wire Industry, vol. 59, No. 5, May 1, 1992, Oxted, Surrey, GB, pp. 395–399.

*Primary Examiner*—Joseph J. Hail, III
*Assistant Examiner*—Ed Tolan
*Attorney, Agent, or Firm*—Frishauf, Holtz, Goodman, Langer & Chick, P.C.

[57] ABSTRACT

Making method of hot-rolled steel sheet comprises rough rolling a slab into a rough bar, heating the rough bar, guiding the rough bar with side guides and finish rolling the rough bar. The apparatus comprises a rough rolling mill, a heating device for heating the rough bar, side guides for guiding the rough bar and a finish rolling mill.

14 Claims, 9 Drawing Sheets

METHOD FOR MAKING HOT-ROLLED STEEL SHEET AND APPARATUS THEREFOR

BACKGROUND OF THE INVENTION

1. Field of the Invention

The present invention relates to a method for making a hot-rolled steel sheet and an apparatus therefor.

2. Description of the Related Arts

In general, a hot-rolled steel sheet is produced by the following continuous hot rolling process. A slab is heated to a given temperature in a heating furnace. The heated slab is rolled into a rough bar having a specified thickness with a rough rolling mill. Both ends of the rough bar is heated with an edge heater. Thereafter, the rough bar is finish-rolled into a hot-rolled steel sheet having a predetermined thickness in a continuous hot finish rolling mill having a plurality of stands. The hot-rolled steel sheet is cooled on a cooling stand provided on a run-out table and coiled with a coiler.

In the continuous hot rolling process, shape defects, such as "upper curl" and "edge wave", may form at the front end of the rough bar rolled into a given thickness by the rough rolling mill. If the above shape defects form in the rough bar, the rough bar will be damaged due to collision of the rough bar with the edge heater during heating.

Also, the temperature distribution of the rough bar in the transverse direction is nonuniform for the reasons, such as asymmetrical temperature distribution of the slab generated during slab heating, asymmetrical temperature distribution of the rough bar caused in the rough rolling, and temperature decrease at both edge sections of the rough bar.

Nonuniform temperature distribution of the rough bar in the transverse direction causes occurrence in edge wave and center buckle during finish rolling and decrease in finish rolling temperature at the edge sections lower than a phase transformation temperature of the steel, resulting in a decreased yield.

A heating furnace for the slab is provided with a transfer mechanism for transferring slabs fed into the furnace, and the slabs in the furnace are supported by walking beams. The interior of each walking beam is cooled with water to a temperature lower than that of the slab.

In the slab discharged from the heating furnace, the sections being in contact with the walking beams have temperatures lower than those in other sections which does come in contact with the walking beams. The low temperature sections are present at the same frequency as that of the walking beams and called skid marks. When rolling a slab having such skid marks, the shape and quality change at the skid mark positions, resulting in quality deterioration.

SUMMARY OF THE INVENTION

It is an object of the present invention to provide a method and an apparatus for making a hot-rolled steel sheet wherein a hot-rolled steel sheet having a uniform temperature distribution and exhibiting decreased unevenness is produced in a high yield.

To attain the object, the present invention provides a first method for making a hot-rolled steel sheet, which includes rough rolling a slab into a rough bar with a rough rolling mill and finish rolling the rough bar into the hot-rolled steel sheet with a finish rolling mill.

The first method comprises the steps of: providing a leveller, a heating device and side guides; providing curl detectors; correcting flatness defect; heating the rough bar; and guiding the rough bar.

The leveller, the heating device for heating the rough bar and the side guides for guiding the rough bar are arranged between the rough rolling mill and the finish rolling mill. The leveller corrects a flatness defect of the rough bar. The curl detectors detect curls of the rough bar. The curl detectors are arranged at an inlet side and an outlet side of the leveller.

In the step of correcting, the flatness defect of the rough bar is corrected by the leveller based on an amount of the curl detected by the curl detectors. In the step of heating, the rough bar after correction of the flatness defect is heated by the heating device over the entire transverse direction. In the step of guiding, the rough bar is guided by the side guides so that a center line in the transverse direction of the rough bar agrees with a center line of the leveller and a center line of the heating device.

To perform the first method for making the hot-rolled steel sheet, the present invention provides a first apparatus for making a hot-rolled steel sheet.

The first apparatus comprises a rough rolling mill, a finish rolling mill, a leveller, a heating device, curl detectors, and side guides.

The rough rolling mill rolls a slab into a rough bar. The finish rolling mill rolls the rough bar into a hot-rolled steel sheet. The leveller corrects a flatness defect of the rough bar. The leveller is arranged between the rough rolling mill and the finish rolling mill. The heating device heats the rough bar over an entire transverse direction. The curl detectors detects curls of the rough bar. The curl detectors are arranged at an inlet side and an outlet side of the leveller. The rough bar is guided by the side guides such that a center line in the transverse direction of the rough bar agrees with a center line of the leveller and a center line of the heating device.

Further, the present invention provides a second method for making a hot-rolled steel sheet, having rough rolling a slab into a rough bar with a rough rolling mill and finish rolling the rough bar into the hot-rolled steel sheet with a finish rolling mill.

The second method comprises the steps of: providing a solenoid-type induction heating device and an edge heater; and heating the rough bar. The solenoid-type induction heating device heats the rough bar over the entire transverse direction. The edge heater heats both edge sections of the rough bar. The solenoid-type induction heating device and the edge heater are arranged between the rough rolling mill and the finish rolling mill. In the step of heating, the rough bar is heated by the solenoid-type induction heating device and said edge heater such that the rough bar at the inlet side of said finish rolling mill has uniform temperature in the transverse direction.

To perform the second method for making the hot-rolled steel sheet, the present invention provides a second apparatus for making a hot-rolled steel sheet.

The second apparatus comprises a rough rolling mill for rough rolling a slab into a rough bar; a finish rolling mill for finish rolling the rough bar into a hot-rolled steel sheet; a solenoid-type induction heating device for heating the rough bar in the entire transverse direction; and an edge heater for heating both edge sections of the rough bar. The solenoid-type induction heating device and the edge heater are arranged between the rough rolling mill and the finish rolling mill.

Furthermore, the present invention provides a third method for making a hot-rolled steel sheet.

The third method comprises the steps of:

providing a solenoid-type induction heating device for heating the rough bar over the entire transverse direction between the rough rolling mill and the finish rolling mill;

detecting a temperature of the rough bar at the inlet or outlet side of said solenoid-type induction heating device; and controlling the solenoid-type induction heating device, when variations in temperature in the longitudinal direction of the rough bar are detected in the detecting step, so as to compensate for the variations in temperature.

To perform the third method for making the hot-rolled steel sheet, the present invention provides a third apparatus for making a hot-rolled steel sheet.

The third apparatus comprises: a rough rolling mill for rough rolling a slab into a rough bar; a finish rolling mill for finish rolling the rough bar into a hot-rolled steel sheet; a solenoid-type induction heating device; a temperature detecting means for detecting a temperature of said rough bar at the inlet or outlet side of said solenoid-type induction heating unit; and a controlling means for controlling said solenoid-type induction heating device.

Moreover, the present invention provides a fourth method for making a hot-rolled steel sheet, having rough rolling a slab into a rough bar with a rough rolling mill and finish rolling the rough bar into the hot-rolled steel sheet with a finish rolling mill.

The fourth method comprises the steps of:

providing at least two heating device for heating the rough bar between the rough rolling mill and the finish rolling mill;

heating the rough bar with said at least two heating device; and guiding the rough bar so that a width center line of the rough bar agrees with a center line of a hot rolling line.

To perform the fourth method for making the hot-rolled steel sheet, the present invention provides a fourth apparatus for making a hot-rolled steel sheet, the fourth apparatus comprising:

a rough rolling mill for rough rolling a slab into a rough bar;

a finish rolling mill for finish rolling the rough bar into a hot-rolled steel sheet;

at least two heating device for heating the rough bar, said at least two heating device being arranged between the rough rolling mill and the finish rolling mill; and side guides for restraining a movement of the rough bar in the width direction, the side guides being arranged between the at least two heating devices.

DESCRIPTION OF THE EMBODIMENT

Embodiment 1

The present inventors have intensively studied a method in which a rough bar can be heated with uniform temperature distribution in the transverse direction at the inlet side of a finish rolling mill. As a result, the present inventors have discovered that the rough bar can be heated with uniform temperature distribution in the transverse direction, when the curl of the rough bar is detected by a curl detector provided between a rough rolling mill and a finish rolling mill, the flatness defects of the rough bar are corrected with flatness correcting equipment in response to an amount of the curl, and the rough bar after correction of the flatness defects is guided to a rough bar heating equipment and an edge heater with a side guide so that the center line of the rough bar in the transverse direction agrees with the center of the flatness correcting equipment and the center of a rough bar heating equipment.

Figure 1:
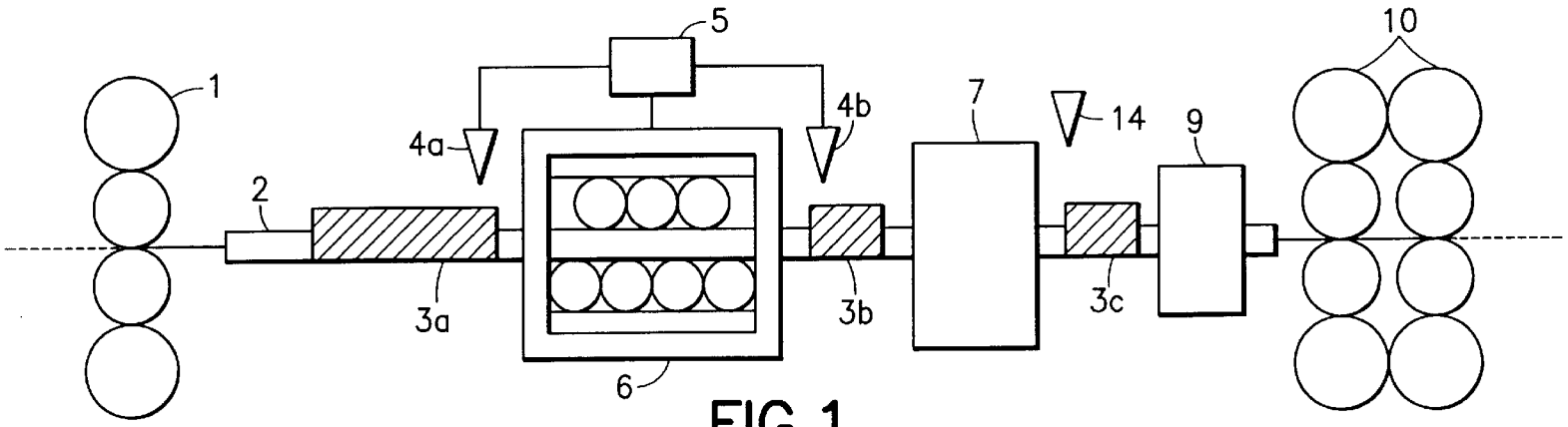
FIG. 1 is a schematic side view of an apparatus in accordance with the embodiment 1.
Figure 2:
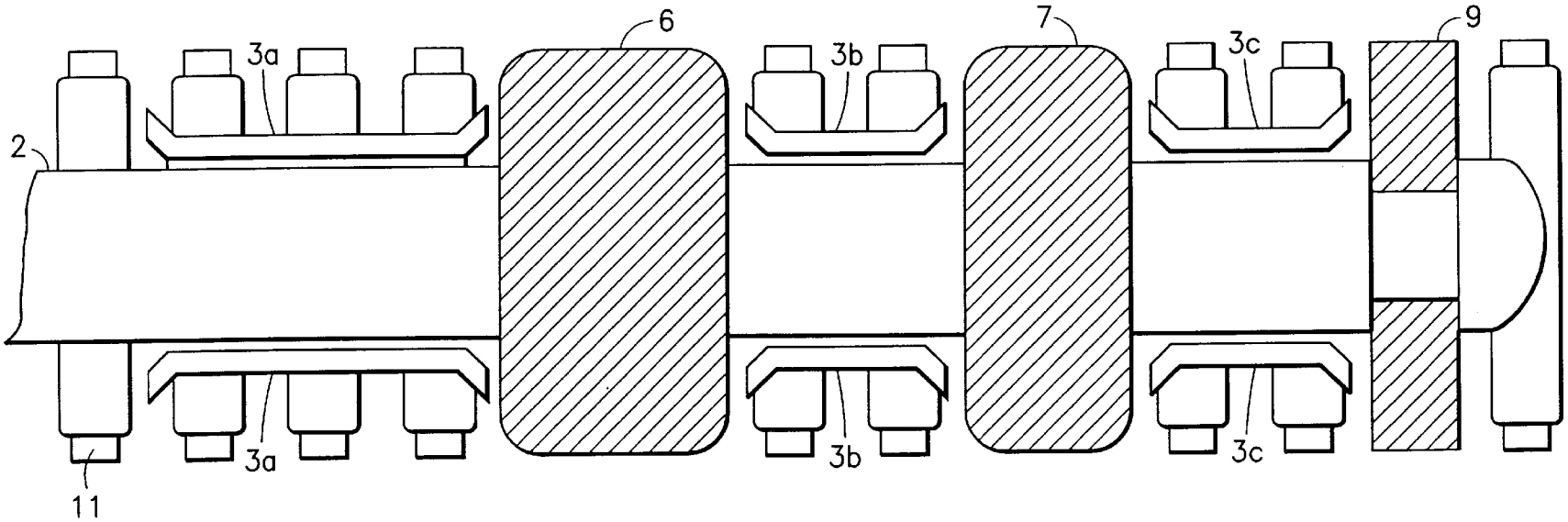
FIG. 2 is a partly enlarged plan view of an apparatus in accordance with the embodiment 1.

FIG. 1 is a schematic side view of an embodiment of an apparatus in accordance with the present invention. As shown in the drawing, a leveller 6 as rough bar flatness correcting equipment, induction heating equipment 7 for heating the rough bar, and an edge heater 9 are provided in this order between a rough rolling mill 1 and a continuous hot finish rolling mill 10 comprising a plurality of stands.

Side guides 3*a*, 3*b* and 3*c* are provided at the inlet side of the flatness correcting equipment 6, between the leveler 6 and the induction heating equipment 7, and between the induction heating equipment 7 and the edge heater 9, respectively. Curl detectors 4*a* and 4*b* are provided at the inlet side and the outlet side of the leveller 6, respectively, so that the leveler 6 is controlled with controlling equipment 5 based on the detected value.

The rough bar rolled with the rough rolling mill 1 is fed to the leveler 6 to correct the flatness defects, such as upper curl and edge wave, at the front edge. The leveller 6 is adequately controlled by the controlling equipment 5 in response to the curl of the rough bar 2 detected by the detectors 4*a* and 4*b*.

The rough bar 2 after correction of the flatness defects is then continuously heated in the induction heating equipment 7 over the entire transverse direction to raise temperature throughout the rough bar, and both the edge sections are heated with the edge heater 9 to compensate for temperature decrease and to achieve uniform temperature distribution in the transverse direction.

Figure 3:
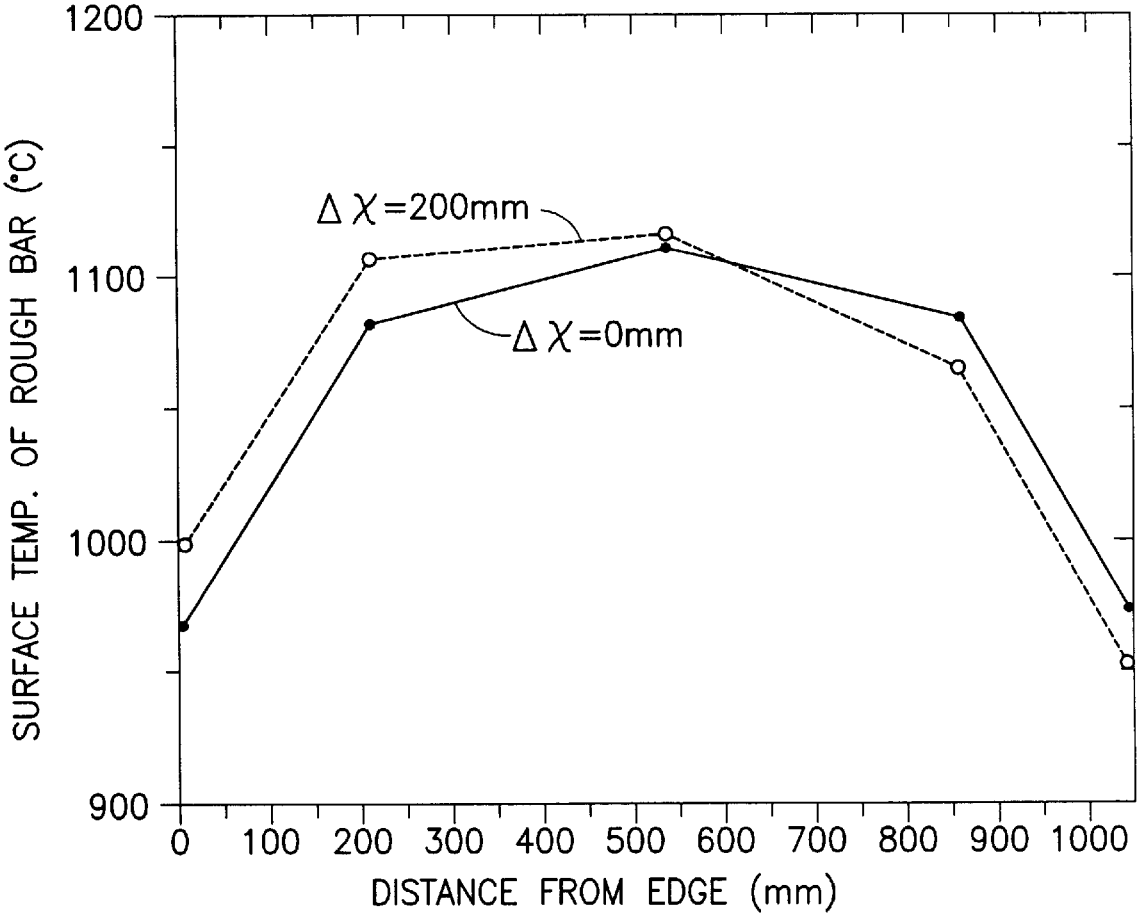
FIG. 3 is a graph of temperature distribution of the rough bars after heating in accordance with the embodiment 1, as well as that in prior art.

During the above steps, the rough bar 2 is transferred by the side guides 3*a*, 3*b* and 3*c* so that the deviation (Δx) between the center line 12 of the rough bar 2 in the transverse direction and the center line 13 of the rolling line, as shown in FIG. 3, is zero. The transferred rough bar 2 does not collide with the induction heating equipment 7 and the edge heater 9 and no deviation of the temperature distribution in the transverse direction of the rough bar 2 occurs during heating in the induction heating equipment 7.

The rough bar 2 is finish-rolled to a hot-rolled steel sheet having a given thickness by the finish rolling mill 10, while shape defects of the steel sheet in the transverse direction and meandering of the steel sheet due to deviation of the temperature distribution in the transverse direction formed during heating by the induction heating equipment 7 and the edge heater 9, can be prevented.

Example

The present invention will now be described in detail with reference to an example. A carbon steel slab having a size of 226-mm height, 1,050 mm width and 9,200 mm length, was heated to a temperature of 1,230° C. in a heating furnace, and was rough-rolled by a rough rolling mill 1 in a facility shown in FIG. 1 to a rough bar 2 having a thickness of 30 mm and a width of 1,050 mm. Next, the rough bar 2 was passed through a leveler 6 to correct for flatness, heated by induction heating equipment 7 and an edge heater 9 to achieve a given temperature distribution in the transverse direction, and finish-rolled by a continuous hot finish rolling mill 10. A hot-rolled steel sheet having a thickness of 2 mm and a width of 1,050 mm was prepared in such a manner.

The rough bar 2 was subjected to temperature measurement at a position being approximately 30 m from the front end with a radiation thermometer 14 provided at the outlet side of the induction heating equipment 7 during the above-mentioned rolling step, and the temperature distribution in the transverse direction is shown in FIG. 3. In FIG. 3, symbol ● represents temperature distribution in which the rough bar 2 is transferred with the side guides 3*a*, 3*b* and 3*c* so that the deviation (Δx) between the center line of the rough bar 2 in the transverse direction and the center line of the rolling line is zero, and symbol ○ represents temperature distribution in which no side guide is provided and Δx is 200 mm.

FIG. 3 evidently demonstrates that temperature distribution in the transverse direction is nonuniform when no side guide is provided and Δx is 200 mm. In contrast, approximately symmetrical temperature distribution is achieved when side guides are provided and Δx is 0, the rough bar does not collide with the induction heating equipment 7 and the edge heater 9, temperature distribution of the rough bar 2 in the transverse direction does not deviate during heating with the induction heating equipment 7, and thus a hot-rolled steel sheet having an accurate shape can be produced.

The present invention, as described above, has industrially useful advantages, that is, flatness defects of a rough bar, which was rough-rolled with a rough rolling mill, are corrected during finish rolling of the rough bar by a finish rolling mill, deviation of the rough bar from the center line along the transverse direction is adequately corrected, the rough bar can be heated so as to have uniform temperature distribution in the transverse direction without a temperature difference of the rough bar between both the edge sections and the center, and a hot-rolled steel sheet having an accurate shape in the transverse direction can be produced in a high yield.

Embodiment 2

The present inventors have intensively studied for developing a method capable of heating a rough bar at the inlet side of a finish roll mill so as to achieve uniform temperature distribution in the transverse direction. As a result, the present inventors have discovered that the rough bar can be heated to uniform temperature distribution in the transverse direction when the entire rough bar is heated with a solenoid-type induction heating unit and both edge sections is heated with an edge heater, which the solenoid-type induction heating unit and the edge heater are provided between a rough rolling mill and a finish rolling mill.

The present invention has been accomplished based on the above-mentioned knowledge. A method for rolling a hot-rolled steel sheet comprising rough rolling a slab into a rough bar with a rough rolling mill and finish rolling the rough bar into a given thickness with a continuous hot finish rolling mill, is characterized in that a solenoid-type induction heating unit for heating the rough bar over the entire transverse direction and an edge heater for heating both edge sections of the rough bar is provided between the rough rolling mill and the finish rolling mill, so that the rough bar at the inlet side of the finish rolling mill is heated to uniform temperature in the transverse direction by the solenoid-type induction heating unit and the edge heater.

Figure 4:
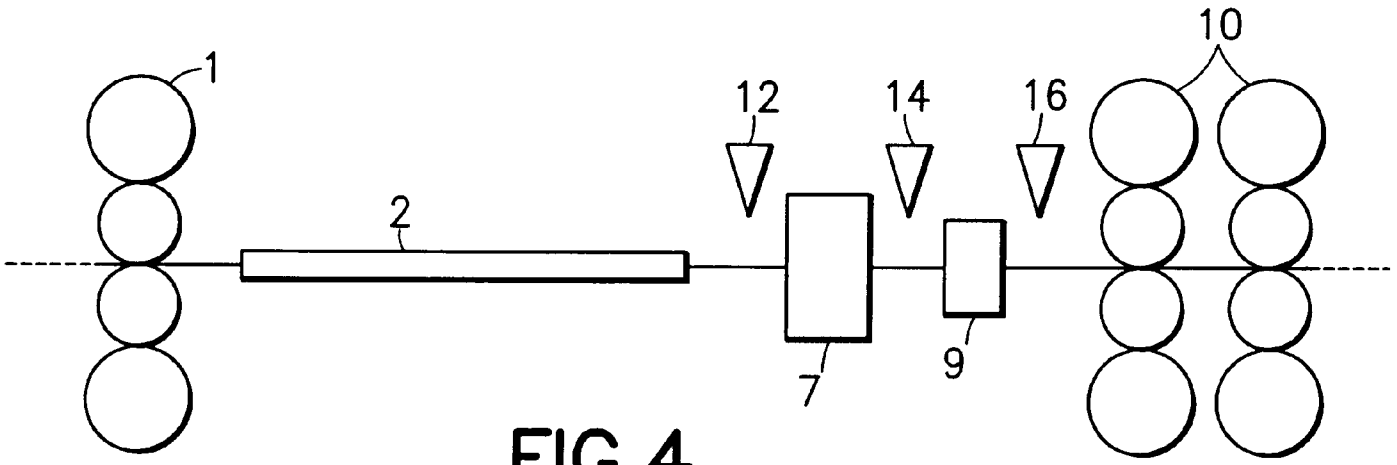
FIG. 4 is a schematic side view of an apparatus in accordance with the embodiment 2.

FIG. 4 is an outlined side view of the embodiment 2 of the present invention. As shown in the drawing, a solenoid-type induction heating unit 7 and an edge heater 9 are provided between a rough rolling mill 1 and a continuous hot finishing rolling mill 10 comprising a plurality of stands, a first thermometer 12 is provided at the inlet side of the induction heating unit 7, a second thermometer 14 is provided between the induction heating unit 7 and the edge heater 9, and a third thermometer 16 is provided between the edge heater 6 and the finish rolling mill 10.

The rough bar 2 rough-rolled with a rough rolling mill 1 moves along a table roll and is continuously heated by the solenoid-type induction heating unit 7 over the entire transverse direction, and both the edge sections at a relatively low temperature of the rough bar 2 are heated with the edge heater 9. Uniform temperature distribution in the transverse direction is achieved in such a manner.

The surface temperature of the rough bar 2 at the inlet side of the solenoid-type induction heating unit 7 is measured with the first thermometer 12, the surface temperature at the inlet side of the edge heater 9 is measured with the second thermometer 14, and the surface temperature at the outlet side of the edge heater 9 is measured with the third thermometer 16. Based on these measured values, heating conditions of the solenoid-type induction heating unit 7 and the edge heater 9 are controlled so as to uniformly heat the entire rough bar 2 over the transverse direction, and the rough bar 2 has uniform temperature distribution in the transverse direction. The rough bar 2 is finish-rolled with a finish rolling mill 10 to prepare a hot-rolled steel sheet having a given thickness in such a manner.

In accordance with the present invention, the entire rough bar 2 is uniformly heated along the transverse direction by the solenoid-type induction heating unit 7 and the edge heater 9 and then finish-rolled by the finish rolling mill 10. Thus, rolling load in the finish rolling mill is decreased and the finish rolling temperature can be maintained at a temperature higher than a transformation temperature of the steel, required for excellent characteristics. Since the rough bar 2 has uniform temperature distribution in the transverse direction at the inlet side of the finish rolling mill, a hot-rolled steel sheet having low quality variations in the transverse direction can be effectively produced.

Example

The present invention will now be described in detail with reference to an example. A carbon steel slab having a size of 226-mm height, 900 mm width and 9,100 mm length, was heated to a temperature of 1,230° C. in a heating furnace, and was rough-rolled by a rough rolling mill 1 in a facility shown in FIG. 4 to a rough bar 2 having a thickness of 38 mm. Next, the rough bar 2 was heated by a solenoid-type induction heating unit 7 and an edge heater 9 to achieve a given temperature distribution, and finish-rolled by a continuous hot finish rolling mill 10. A hot-rolled steel sheet having a thickness of 2 mm and a width of 840 mm was prepared.

The rough bar 2 was subjected temperature measurement at the center and an edge section of the front end using the first thermometer 12, the second thermometer 14 and the third thermometer 16. These temperatures are shown in Table 1 with temperature differences between the center and the edge section.

TABLE 1

| | Surface temperature of rough bar (°C.) | | |
|---|---|---|---|
| | Center | Edge | Difference |
| First thermometer | 1,043 | 1,002 | 41 |
| Second thermometer | 1,100 | 1,062 | 38 |
| Third thermometer | 1,098 | 1,095 | 3 |

Table 1 demonstrates that the surface temperatures of the rough bar before heating by the solenoid-type induction heating unit 7, which was measured by the first thermometer 12, are 1,043° C. at the center and 1,002° C. at the edge section, and the difference between them is 41° C. The surface temperatures of the rough bar after heating by the solenoid-type induction heating unit 7, which was measured by the second thermometer 14, are 1,100° C. at the center and 1,062° C. at the edge section, and the difference between them is 38° C. although both temperatures increase by heating. The surface temperature of the rough bar after heating by the edge heater 9 are 1,098° C. at the center and 1,095° C. at the edge section, and the difference between them is merely 3° C. The rough bar can be heated so as to achieve uniform surface temperature.

The present invention, as described above, has industrially useful advantages, that is, the rough bar can be heated so as to have uniform temperature distribution in the transverse direction without a temperature difference of the rough bar between both the edge sections and the center during heating by a solenoid-type induction heating method at the inlet side of a finish rolling mill, rolling load can be decreased during finish rolling as a result, the finish rolling temperature can be held at a temperature higher than a transformation temperature of the steel so as to achieve excellent material quality, and a hot-rolled steel sheet having an accurate shape in the transverse direction can be produced in a high yield.

Embodiment 3

Embodiments of the present invention will now be described with reference to drawings.

Embodiment 3-1

Figure 5:
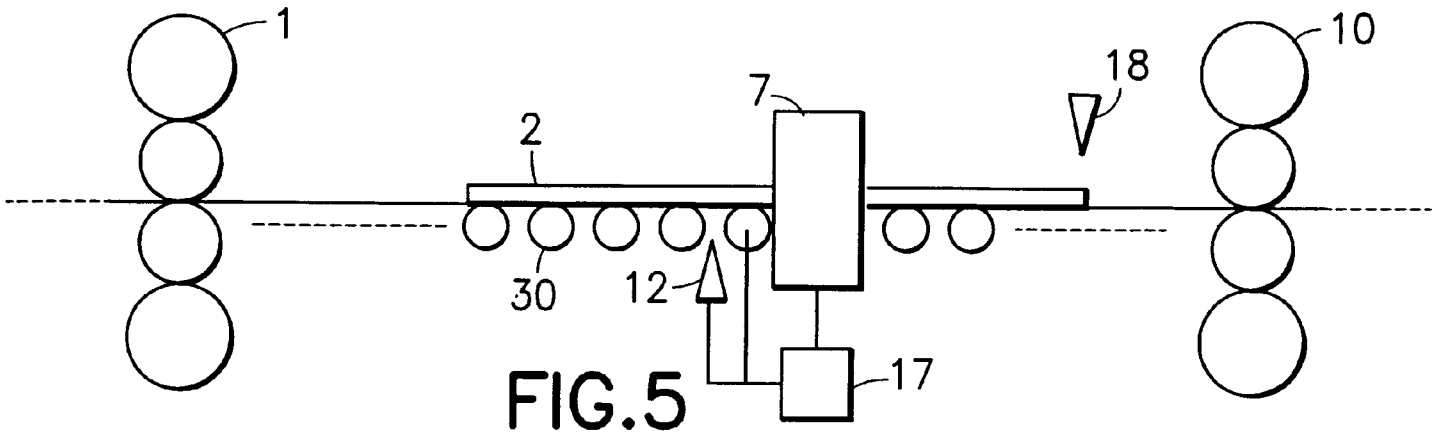
FIG. 5 is a side view illustrating a schematic view of an apparatus in accordance with the embodiment 3-1.

FIG. 5 is a side view illustrating an outlined configuration of a hot rolling apparatus in accordance with a first embodiment of the present invention. This hot rolling apparatus is provided with a rough rolling mill 1 for rough-rolling a slab into a rough bar 2, a plurality of table rolls 30 for transferring the rough bar 2 which was rough-rolled by the rough rolling mill 1, a finish rolling mill 10 for finish-rolling the rough bar transferred on the table roll 30 into a hot-rolled steel sheet having a given thickness, a solenoid-type induction heating unit 7 for the rough bar 2 provided between the rough rolling mill 1 and the finish rolling mill 10, an inlet side thermometer 12 for measuring the surface temperature of the rough bar 2, a control unit 17 for controlling the solenoid-type induction heating unit 7 based on the detected results from the inlet side thermometer 12, and a finish rolling mill inlet side thermometer 18, provided at the inlet side of the finish rolling mill 10, for measuring the surface temperature of the rough bar 2.

The solenoid-type induction heating unit 7 is provided between the rough rolling mill 1 and the finish rolling mill 10, and heats the rough bar 2 over the entire transverse direction under control of the controlling unit 17.

The inlet side thermometer 12 detects the surface temperature of the rough bar 2 at the inlet side of the solenoid-type induction heating unit 7, and feeds the detected results to the control unit 7.

If variations in temperature in the longitudinal direction of the rough bar 2 is detected based on the detected results from the inlet side thermometer 12, the control unit 7 controls the solenoid-type induction heating unit 7 so as to start or enhance the heating when the low temperature sections enter the solenoid-type induction heating unit 7 and to stop or diminish the heating when the low temperature section of the rough bar 2 is released from the solenoid-type induction heating unit 7.

In the control unit 7, timing for starting, enhancing, stopping or diminishing the heating can be determined based on a time, at which the lowest temperature portion of a skid mark is detected by the inlet side thermometer 12, and a rotation rate of the table roll 3.

A method for making a hot-rolled steel sheet with the hot rolling apparatus having the above-mentioned configuration will now be described.

The slab is rough-rolled into a rough bar 2 while forming skid marks at contact sections with the walking beam during heating.

Figure 6:
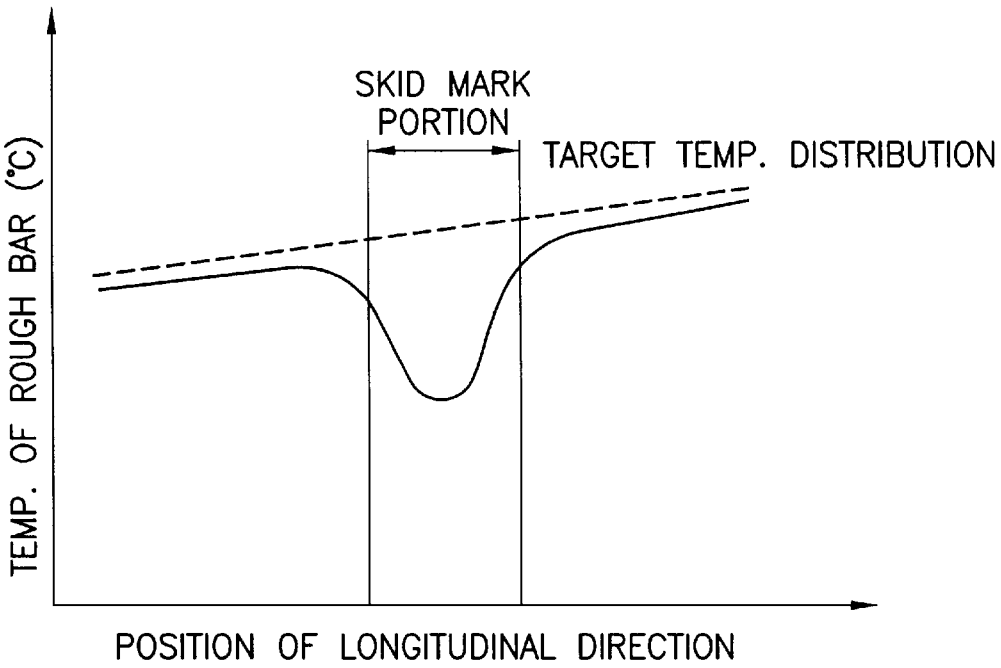
FIG. 6 is a graph of temperature distribution near a skid mark of a rough bar along the longitudinal direction in the embodiment 3-1.

The rough bar 2 having skid marks reaches the inlet of the solenoid-type induction heating unit 7 as shown in FIG. 6, the skid marks are detected by the inlet side thermometer 12, which transmits the detected results to the control unit 17.

The control unit 17 controls the solenoid-type induction heating unit based on the detected results and starts or enhances induction heating of the skid mark sections in the rough bar 2.

Figure 7:
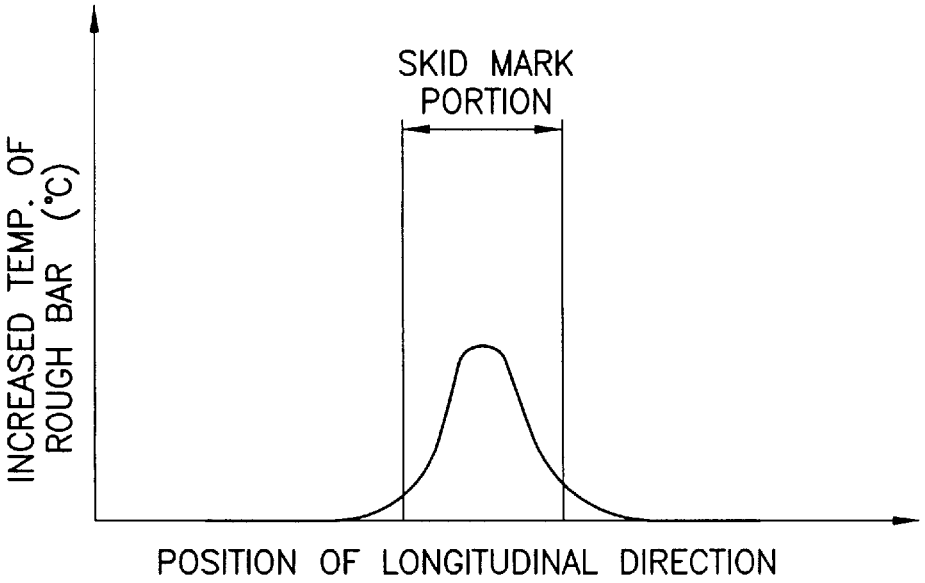
FIG. 7 is a graph illustrating the amount of heat-up added to the rough bar near the skid mark in the embodiment 3-1.

Also the control unit 17 controls the solenoid-type induction heating unit 7 when the skid marks reach the outlet of the solenoid-type induction heating unit 7 and stops or diminishes the induction heating of the skid mark sections. The energy for temperature rising by means of induction heating is given to the rough bar 2 as shown in FIG. 7 so as to compensate for the decreased thermal energy at the skid mark section shown in FIG. 6.

Therefore, variations in shape and material due to skid marks can be prevented by removing skid marks by means of achievement of uniform temperature distribution in the longitudinal direction, since only the low temperature skid mark sections are induction-heated.

In accordance with this embodiment as described above, since the control unit 17 controls the solenoid-type induction heating unit 7 provided between the rough rolling mill 1 and the finish rolling mill 10 based on the temperature of the rough bar 2 detected by the inlet side thermometer 12 provided at the inlet side thereof, the skid marks are removed by heating, and variations in shape and material due to the skid marks can be prevented as a result.

Accordingly, variations in temperature distribution and skid marks of the rough bar 2 in the longitudinal direction can be removed and quality of the rough bar can be improved by uniformly heating the rough bar 2 in the transverse direction in response to the skid marks.

Further, the solenoid-type induction heating unit 7 has some advantages which cannot be achieved by a conventional direct electric heating system and a transverse-type induction heating system, i.e., it does not damage the rough bar 2 due to non-contacting heating and it enables uniform heating of the rough bar 2 in the transverse direction.

The solenoid-type induction heating system has a heating efficiency of 0.75, and thus a time period requiring for heat-up of 10° C. (hereinafter referred to as a heat-up time period) is 8 seconds. Therefore, it has excellent heating efficiency and response to control compared to a transverse-type induction heating system which has a heating efficiency of 0.65 and a heat-up time period of 13 seconds.

Additionally, since the rough bar 2 which is thinner than the slab can be easily heated by the solenoid-type induction heating unit 7 provided between the rough rolling mill 1 and the finish rolling mill 10, thermal equalization can be rapidly achieved after heating and the unit can be miniaturized.

Because the rough bar 2 has longer skid marks compared to the slab, time intervals for start, end, increase and decrease of induction heating can be increased by providing the solenoid-type induction heating unit 7 between the rough rolling mill 1 and the finish rolling mill 10, and heating can be readily controlled.

Embodiment 3-2

A hot rolling apparatus in accordance with a second embodiment of the present invention will now be described.

Figure 8:
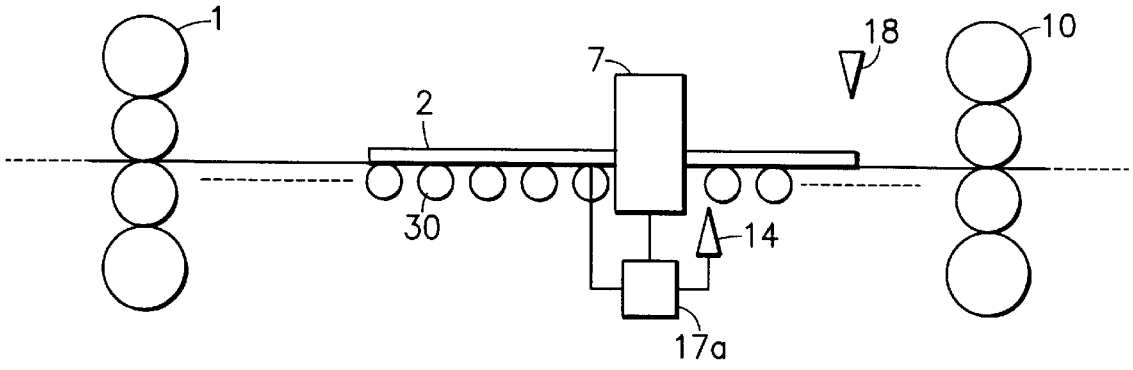
FIG. 8 is a side view illustrating a schematic configuration of a apparatus in accordance with the embodiment 3-2.

FIG. 8 is a side view illustrating an outlined configuration of the hot rolling apparatus. The same sections as in FIG. 5, denoted by the same reference numerals, will not be described in detail, and thus only different sections will be described.

The hot rolling apparatus in accordance with the second embodiment is a modification of the first embodiment. In detail, as shown in FIG. 8, the apparatus is provided with an outlet thermometer 9, instead of the inlet side thermometer 12 and the control unit 17, at the outlet side of the solenoid-type induction heating unit 7, and a control unit 17*a* for controlling the solenoid-type induction heating unit 7 based on the detected results from the outlet side thermometer 14.

The outlet side thermometer 14 detects the surface temperature of the rough bar 2 at the outlet side of the solenoid-type induction heating unit 7 and transmits the detected results to the control unit 17*a*.

The control unit 17*a* controls the solenoid-type induction heating unit 7 so that temperature distribution including variations in temperature agrees with the targeted temperature distribution when the variations in temperature of the rough bar 2 in the longitudinal direction is detected by the outlet side thermometer.

Next, a method for making a hot-rolled steel sheet using the hot rolling apparatus having the above-mentioned configuration will now be described.

When a rough bar 2 having skid marks enters into the solenoid-type induction heating unit 7 and reaches the exit of the solenoid-type induction heating unit 7, a skid mark is detected by the outlet side thermometer 14. The outlet side thermometer 14 transmits the detected results to the control unit 17*a*.

The control unit 17*a* controls the output of the solenoid-type induction heating unit 7 so that the temperature distribution of the rough bar 2 in the longitudinal direction agrees with the targeted temperature distribution as shown in the broken line in FIG. 6, base on the detected results.

Therefore, the skid mark of the rough bar 2 can be removed, and the temperature distribution can be equalized along the longitudinal direction of the rough bar 2.

The embodiment 3-2 as described above can achieve the same advantages as in the embodiment 3-1.

Example

An example in accordance with the above-described embodiments will now be described with reference to a comparative example.

(Common Production Step)

A steel sheet slab having a thickness of 226 mm, a width of 1,000 mm and a length of L mm was heated to 1,230° C. in a heating furnace, and rough-rolled into a rough bar 2 having a thickness of 38 mm with a rough rolling mill 1. The rough bar 2 was finish-rolled with a finish rolling mill to prepare a hot-rolled steel sheet having a thickness of 2.6 mm and a width of 943 mm. The length L mm is 9,200 mm for Comparative Example, or 7,800 mm for Example.

(Comparative Example)

Figure 9:
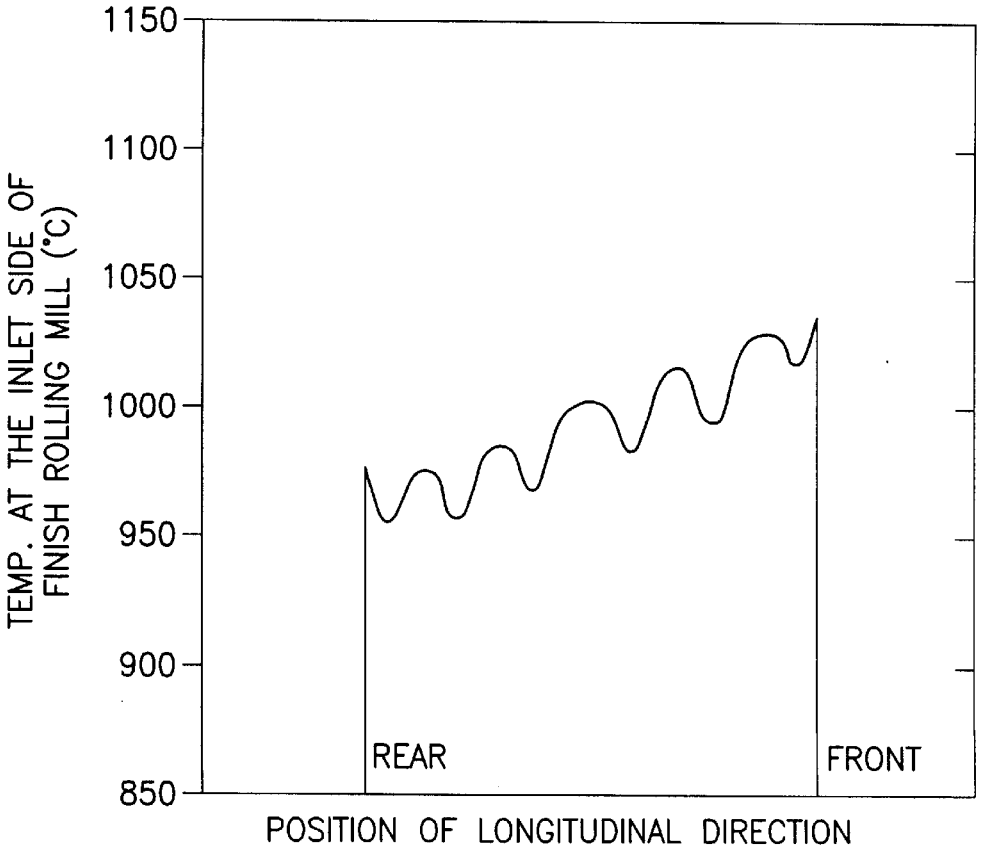
FIG. 9 is a graph of temperature distribution of a rough bar along the longitudinal direction at the inlet side of a finish rolling mill in a conventional technology.
Figure 10:
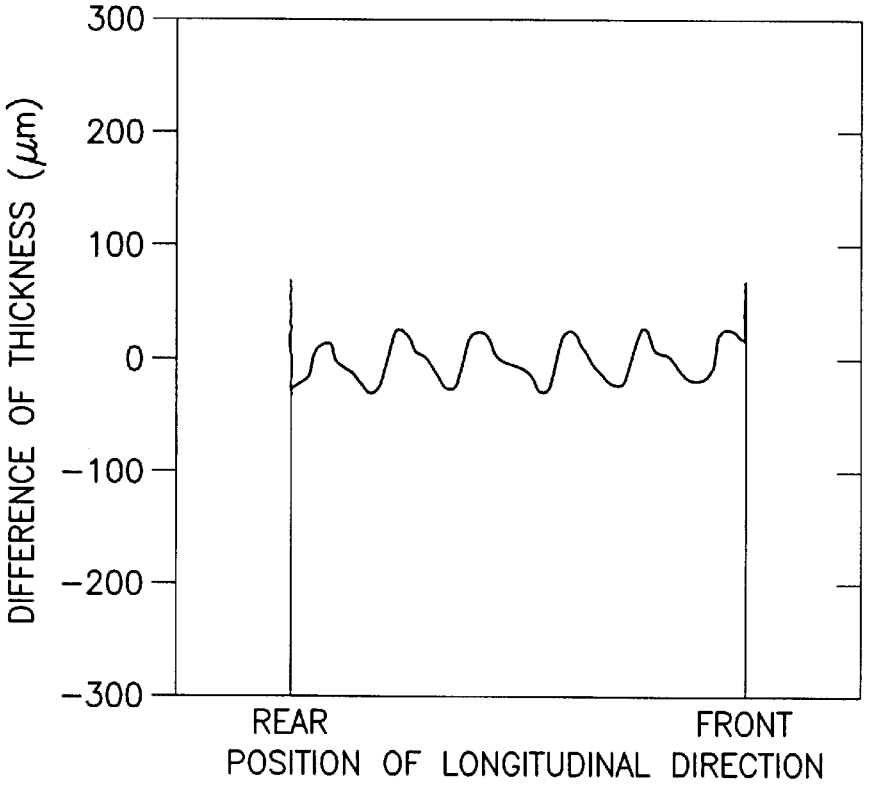
FIG. 10 is a graph of final thickness distribution of a hot-rolled steel sheet along the longitudinal direction in a conventional technology.

In Comparative Example using a conventional technology, the temperature distribution at the inlet side of the finish rolling mill 10, detected by the finish rolling mill inlet side thermometer 18, has variations in temperature ranging from 30 to 40° C. due to skid marks, as shown in FIG. 9. When performing finish rolling in such a state, the thickness distribution along the longitudinal direction after finish rolling has a maximum variation of 60 $\mu$m due to the skid marks, as shown in FIG. 10.

(Example)

Figure 11:
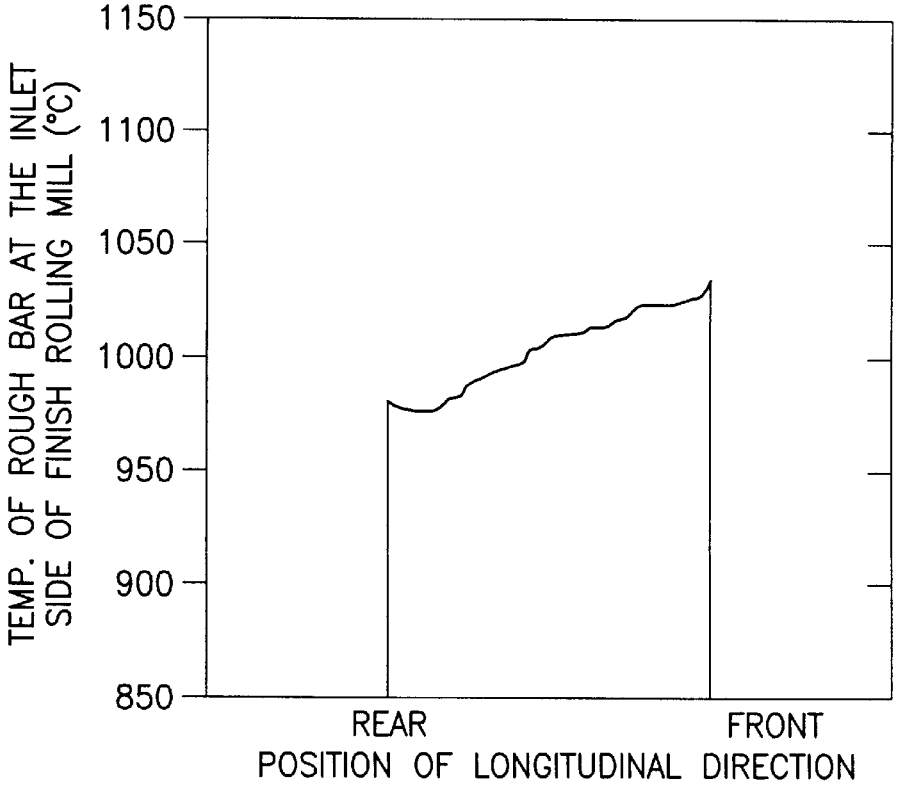
FIG. 11 is a graph of temperature distribution of a rough bar along the longitudinal direction at the inlet side of a finish rolling mill in the embodiment 3-2.
Figure 12:
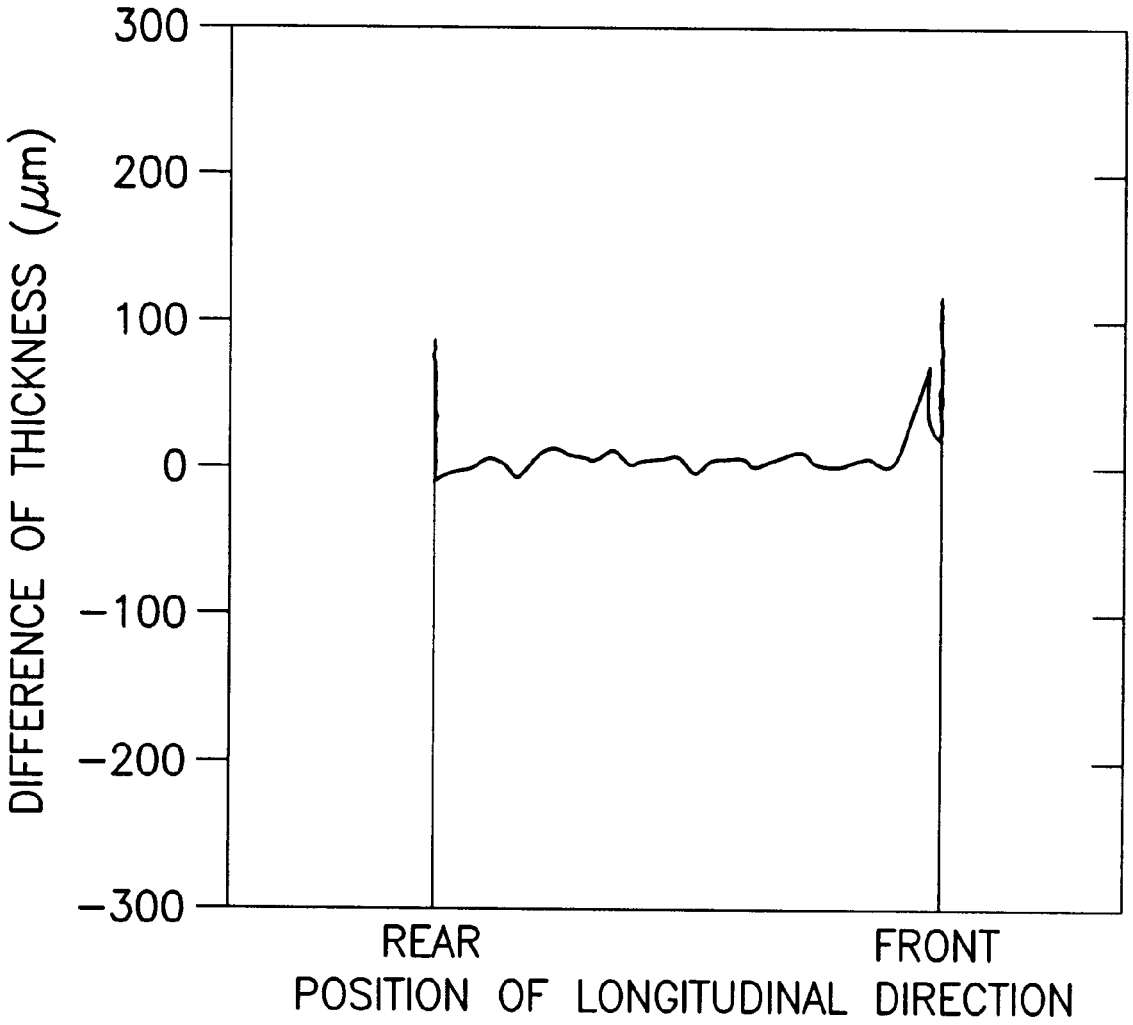
FIG. 12 is a graph of final thickness distribution of a hot-rolled steel sheet along the longitudinal direction in the embodiment 3-2.

In contrast, in Example using the solenoid-type induction heating unit in accordance with the second embodiment of the present invention, no variation in temperature distribution due to skid marks is found as shown in FIG. 11. As a result, variations in thickness distribution along the longitudinal direction are drastically decreased after finish rolling and approximately equalized as shown in FIG. 12.

In accordance with the Example as described above, variations in temperature ranging from 30 to 40° C. due to skid marks can be removed, and thus variations in thickness, which is 60 $\mu$m at the maximum in Comparative Example, can be equalized.

The modification of the present invention is possible within the scope.

Embodiment 4

A hot rolling equipment array in accordance with the present invention comprises a plurality of heating units provided between a rough rolling mill and a finish rolling mill for heating a rough bar, and side guides provided between individual heating units for restraining transverse movement of the rough bar. By dividing a heating unit into a plurality of units, the total length of each heating unit can be decreased and the distances between individual side guides can also be decreased. Therefore, collision of the rough bar with the heating units can be prevented from happening due to effective restraint of the rough bar by means of side guides. As a result, the heating effect also improves.

Figure 13:
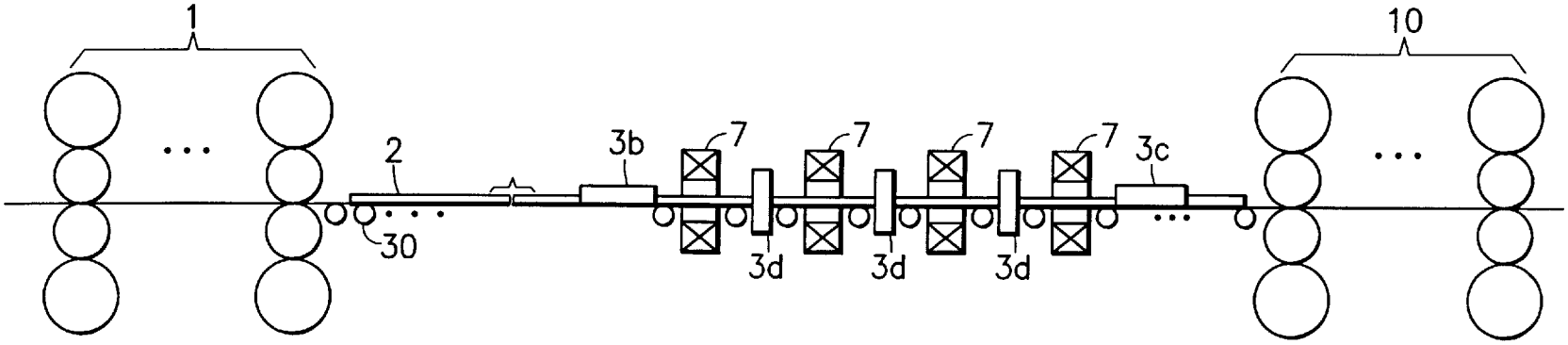
FIG. 13 is a schematic side view illustrating the embodiment 4.

FIG. 13 is an outlined side view of an embodiment of the present invention. A slab having a given temperature is rough-rolled by a rough rolling mill 1 into a rough bar 2, which is heated by heating units 7 while being transferred by a transfer roll 30 to a finish rolling mill 10 and is finish-rolled to a hot-rolled steel sheet having a predetermined thickness.

Figure 14:
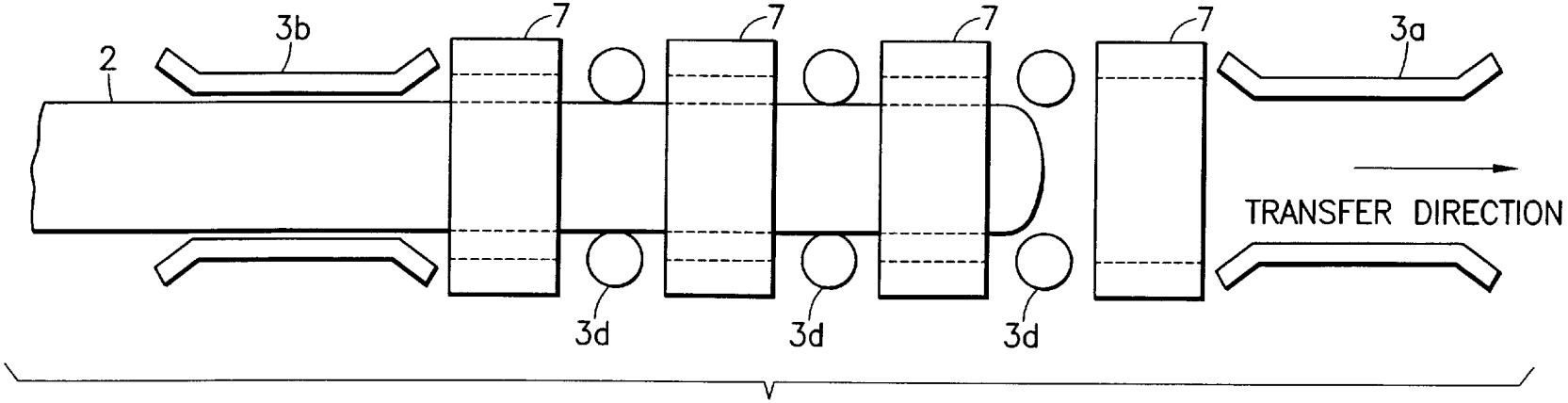
FIG. 14 is a top view of side guides and heating units in accordance with the embodiment 4.

FIG. 14 is a top view illustrating an outline of the present invention. In the present invention, the length of each heating unit 7 is decreased by dividing a heating unit 7 into a plurality of heating units, and side guides 3*d* between heating units are provided between individual heating units 7. Since the distances between side guides are decreased, the front end of the rough bar 2 is restrained by the next side guide immediately after passing through a side guide, resulting in suppressed transverse fluctuation of the rough bar 2. It is preferable that the distance between two adjacent side guides be 2 m or less.

A system using a vertical roller is suitable for the side guides 3*d* between heating units. In typical side guides, such as a side guide 3*b* at the inlet side of the heating unit, shown in FIG. 14, the rough bar 2 and the side guides may be damaged by friction between the rough bar 2 and the side guides. The vertical roller can prevent such damage. The rough bar 2 is transferred while being in contact with the side guides 3*d* between heating units, resulting in increased restraint. By cooling the exterior of the vertical roller (the opposite side of the section being in contact with the rough bar 2), the life of the vertical roller is prolonged, resulting in improved maintenance performance. Although the side guide 3*b* at the inlet side of the heating unit and the side guide 3*d* at the outlet side of the heating unit are general side guides in FIG. 14, they may be vertical rollers.

Heating efficiency can be improved by the present invention. When a solenoid-type induction heating unit is used as a heating unit 7, such efficiency is pronounced. In the solenoid-type induction heating unit, the magnetic flux density at the opening section of the inductor coil increases and the heating efficiency also increase as the area of the opening section (refer to FIG. 15) decreases. Since the transverse movement of the rough bar 2 can be small in the hot rolling equipment in the present invention, the width of the opening section can be designed to be smaller.

In the hot rolling method in accordance with the present invention, using the above-mentioned hot rolling equipment, the rough bar 2 is transferred while restraining the transverse movement of the rough bar 2 by a side guide 3*b* at the inlet side of the heating unit, side guides 3*d* between heating units and a side guide 3*c* at the outlet side of the heating unit, so that the width center line of the rough bar 2 agrees with the center line of the hot rolling line. After the rough bar 2 is heated to give temperature distribution, it is subjected to finish rolling with a finish rolling mill to produce a hot-rolled steel sheet. Contact of the rough bar with the heating unit 7 can be prevented from happening, and the energy consumption rate can be reduced due to improvements in heating efficiency.

Example

The heating efficiency of the solenoid-type induction heating until is improved by the present invention.

Figure 15:
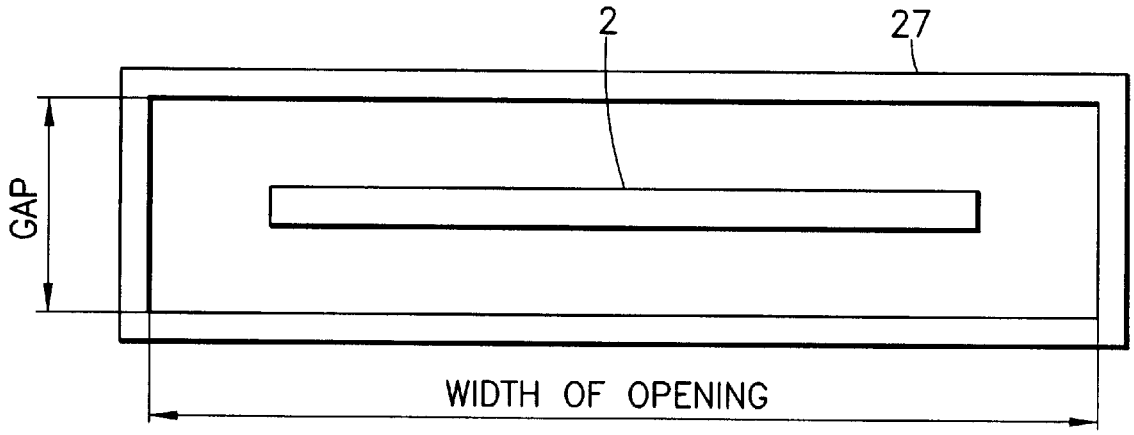
FIG. 15 is a cross-sectional view of an inductor coil of a solenoid-type induction heating unit.
Figure 16:
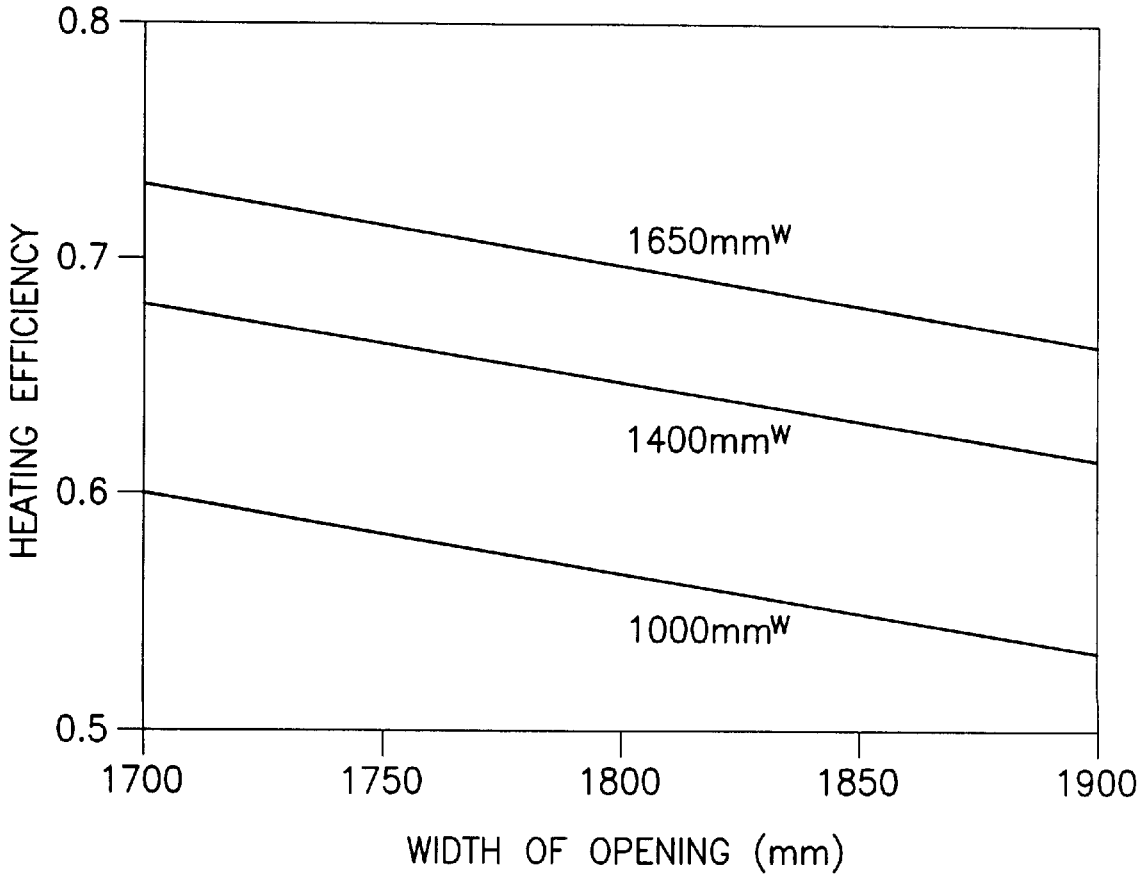
FIG. 16 is a graph illustrating the correlation between an opening of the inductor coil and coil efficiency.

FIG. 15 is a transverse cross-sectional view of an inductor coil of a solenoid-type induction heating unit. The gap represents the height of the opening section of the inductor coil, and the opening width represents the width of the opening section. FIG. 16 shows the correlation between the opening width and heating efficiency. The gap of the opening section is 270 mm, and the rough bar has a size of a thickness of 40 mm, a width of 1,650 mm, 1,400 mm, or 1,000 mm. The heating efficiency decreases as the opening width increases. The opening width is determined by the maximum width of the rough bar. In the hot rolling equipment in this example, the maximum width of the rough bar is 1,650 mm. An opening width prior to the present invention was 1,900 mm, and it can be decreased to 1,750 mm in the present invention. As a result, the heating efficiency improved by approximately 5% from 0.67 to 0.72 in a rough bar having a width of 1,650 mm.

What is claimed is:

1. A method for making a hot-rolled steel sheet, which includes rough rolling a slab into a rough bar with a rough rolling mill and finish rolling the rough bar into the hot-rolled steel sheet with a finish rolling mill, the method comprising the steps of:

providing a leveller for correcting a flatness defect of the rough bar, a heating device for heating the rough bar and side guides for guiding the rough bar between the rough rolling mill and the finish rolling mill;

detecting curls of the rough bar by using curl detectors arranged at an inlet side and an outlet side of the leveller;

correcting the flatness defect of the rough bar by the leveller based on the curl of the rough bar detected by the curl detectors;

heating the rough bar after correction of the flatness defect over the entire transverse direction by the heating device; and guiding the rough bar by the side guides such that a center line in the transverse direction of the rough bar agrees with a center line of the leveller and a center line of the heating device.

2. An apparatus for making a hot-rolled steel sheet, the apparatus comprising:

a rough rolling mill for rough rolling a slab into a rough bar;

a finish rolling mill for finish rolling the rough bar into a hot-rolled steel sheet;

a leveller for correcting a flatness defect of the rough bar, the leveller being arranged between the rough rolling mill and the finish rolling mill;

a heating device for heating the rough bar over an entire transverse direction;

curl detectors for detecting curls of the rough bar, the curl detectors being arranged at an inlet side and an outlet side of the leveller; and side guides for guiding the rough bar such that a center line in the transverse direction of the rough bar agrees with a center line of the leveller and a center line of the heating device.

3. The apparatus of claim 2, wherein said heating device is an induction heating device.

4. A method for making a hot-rolled steel sheet, which includes rough rolling a slab into a rough bar with a rough rolling mill and finish rolling the rough bar into the hot-rolled steel sheet with a finish rolling mill, the method comprising the steps of:

providing a solenoid-type induction heating device for heating the rough bar over the entire transverse direction and an edge heater for heating both edge sections of the rough bar between the rough rolling mill and the finish rolling mill; and heating the rough bar by using the solenoid-type induction heating device and the edge heater such that the rough bar at the inlet side of the finish rolling mill is heated to uniform temperature in the transverse direction.

5. An apparatus for making a hot-rolled steel sheet, the apparatus comprising:

a rough rolling mill for rough rolling a slab into a rough bar;

a finish rolling mill for finish rolling the rough bar into a hot-rolled steel sheet;

a solenoid-type induction heating device for heating the rough bar in the entire transverse direction, the solenoid-type induction heating device being arranged between the rough rolling mill and the finish rolling mill; and an edge heater for heating both edge sections of the rough bar, the edge heater being arranged between the rough rolling mill and the finish rolling mill.

6. A method for making a hot-rolled steel sheet, which includes rough rolling a slab into a rough bar with a rough rolling mill and finish rolling the rough bar into the hot-rolled steel sheet with a finish rolling mill, the method comprising the steps of:

providing a solenoid-type induction heating device between the rough rolling mill and the finish rolling mill;

heating the rough bar over the entire transverse direction;

detecting a temperature of the rough bar at the inlet or outlet side of said solenoid-type induction heating device; and controlling the solenoid-type induction heating device, when variations in temperature in the longitudinal direction of the rough bar are detected in the detecting step, so as to compensate for the variations in temperature.

7. The method of claim 6, wherein said step of controlling the solenoid-type induction heating device comprises:

controlling the solenoid-type induction heating device in a case that variations in temperature in the longitudinal direction of the rough bar is detected at the inlet side of said solenoid-type induction heating device so as to start or enhance said heating when the low temperature section of said rough bar enters to said solenoid-type induction heating device and to stop or diminish said heating when the low temperature section of the rough bar is released from the solenoid-type induction heating device.

8. The method of claim 6, wherein said step of controlling the solenoid-type induction heating device comprises:

controlling said solenoid-type induction heating device when variations in temperature in the longitudinal direction of the rough bar is detected at the outlet side of said solenoid-type induction heating device so that a temperature distribution including said variations in temperature agrees with a targeted temperature distribution.

9. An apparatus for making a hot-rolled steel sheet, the apparatus comprising:

a rough rolling mill for rough rolling a slab into a rough bar;

a finish rolling mill for finish rolling the rough bar into a hot-rolled steel sheet;

a solenoid-type induction heating device for heating the rough bar in the entire transverse direction, the solenoid-type induction heating device being arranged between the rough rolling mill and the finish rolling mill;

a temperature detecting means for detecting a temperature of said rough bar at the inlet or outlet side of said solenoid-type induction heating unit; and a controlling means for controlling said solenoid-type induction heating device when said temperature detecting means detects variations in temperature in the longitudinal direction of said rough bar so as to compensate for said variations in temperature.

10. A method for making a hot-rolled steel sheet, which includes rough rolling a slab into a rough bar with a rough rolling mill and finish rolling the rough bar into the hot-rolled steel sheet with a finish rolling mill, the method comprising the steps of:

providing at least two heating devices for heating the rough bar between the rough rolling mill and the finish rolling mill;

providing side guides for restraining movement of the rough bar in the width direction between the at least two heating devices;

heating the rough bar with said at least two heating devices; and guiding the rough bar so that a width center line of the rough bar agrees with a center line of a hot rolling line.

11. An apparatus for making a hot-rolled steel sheet, the apparatus comprising:

a rough rolling mill for rough rolling a slab into a rough bar;

a finish rolling mill for finish rolling the rough bar into a hot-rolled steel sheet;

at least two heating devices for heating the rough bar, said at least two heating devices being arranged between the rough rolling mill and the finish rolling mill; and side guides for restraining a movement of the rough bar in the width direction, said side guides being arranged between the at least two heating devices.

12. The apparatus of claim 11, wherein said at least two heating devices comprises solenoid-type induction heating device for heating the rough bar over the entire width direction.

13. The apparatus of claim 11, wherein said side guide comprises a vertical roller.

14. The apparatus of claim 11, wherein said side guide comprises a vertical roller and a cooling device for cooling the vertical roller.

* * * * *